United States Patent [19]

Ritchie

[11] Patent Number: 4,674,891

[45] Date of Patent: Jun. 23, 1987

[54] CLOCK

[75] Inventor: Douglas Ritchie, Stowe, Mass.

[73] Assignee: By Design Corp., Cambridge, Mass.

[21] Appl. No.: 824,899

[22] Filed: Jan. 31, 1986

[51] Int. Cl.[4] ..... G04B 19/04

[52] U.S. Cl. ..... 368/238; 368/223; 368/276

[58] Field of Search ..... 368/223–238, 368/276, 327, 62

[56] References Cited

U.S. PATENT DOCUMENTS

| | | | |
|---|---|---|---|
| 2,536,206 | 1/1951 | Newhouse | 368/238 |
| 4,223,402 | 9/1980 | Slemmons | 368/238 |

FOREIGN PATENT DOCUMENTS

| | | | |
|---|---|---|---|
| 827771 | 1/1952 | Fed. Rep. of Germany | 368/238 |
| 1249773 | 9/1967 | Fed. Rep. of Germany | 368/238 |
| 1139119 | 6/1957 | France | 368/238 |
| 282774 | 8/1952 | Switzerland | 368/238 |
| 324250 | 8/1957 | Switzerland | 368/238 |

*Primary Examiner*—Bernard Roskoski

*Attorney, Agent, or Firm*—Wolf, Greenfield & Sacks

[57] ABSTRACT

A clock having an hour housing supporting an hour hand integral therewith in a minute housing supporting a minute hand integral therewith. A battery operated timing mechanism in the hour housing has an hour shaft for driving the hour housing in hand and a minute shaft for driving the minute housing in hand. The coupling of the minute shaft includes a threaded shaft end having opposed flats adapted to force-fit in a centrally disposed hole on the inside of the minute housing. A bracket is provided for supporting the timing mechanism in a fixed position such as from a wall.

17 Claims, 4 Drawing Figures

CLOCK

BACKGROUND AND SUMMARY OF THE INVENTION

The present invention relates in general to a clock and pertains, more particularly, to a battery operated clock that is of relatively simple construction and that has an extremely aesthetic appearance.

It is an object of the present invention to provide a simplified clock construction and one in which the time is indicated without time numerals, primarily by virtue of hand position of the hands of the clock.

Another object of the present invention is to provide an improved clock in which the hands are each integral with a support housing.

Still a further object of the present invention is to provide an improved clock construction in which the components are few, the construction is simple, and the assembly of the clock can be carried out quite readily.

To accomplish the foregoing and other objects, features and advantages of the invention, there is provided a clock having an hour housing supporting an hour hand integral therewith along with a minute housing generally proportional in diameter to the hour housing and supporting a minute hand integral therewith. A battery operated timing mechanism is provided. This is supported primarily in the hour housing and has multiple output drive shafts including an hour driven shaft coupled to the hour housing for driving the housing and in turn the hour hand and a minute driven shaft coupled to the minute housing for driving the minute housing and in turn the minute hand. A counter weight is disposed inside the minute housing along a peripheral side thereof opposite to the minute hand. This is to provide for counter weight balance of the minute hand so as to minimize the drive forces required of the timing mechanism. The coupling of the minute driven shaft includes a threaded shaft end having opposed flats that are adapted to force-fit in a centrally disposed hole on the inside of the minute housing. Means are provided for supporting the timing mechanism in a fixed position. With the timing mechanism in a fixed position, then the output shafts drive the respective housings and thus the hands at standard timing rates corresponding to an hour for one hand and a minute sequence for the other hand. The minute and hour housings are both preferably of substantially circular shape. The hour housing preferably has a conical cavity adapted to receive the hour driven shaft including a central hole for receiving the hour driven shaft in force-fit engagement. The minute housing also has a centrally disposed inner post having therein the hole for receiving the minute driven shaft. The diameter of the hole in the minute housing is less than the diameter of the threaded shaft end so as to provide the force-fit. Positive engagement is also assured by virtue of the aforementioned flats. the counter weight is preferably a metal disk with the minute housing having a small post on the inside for supporting the disk through a hole in the disk. A fastener may be used for attaching the disk.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
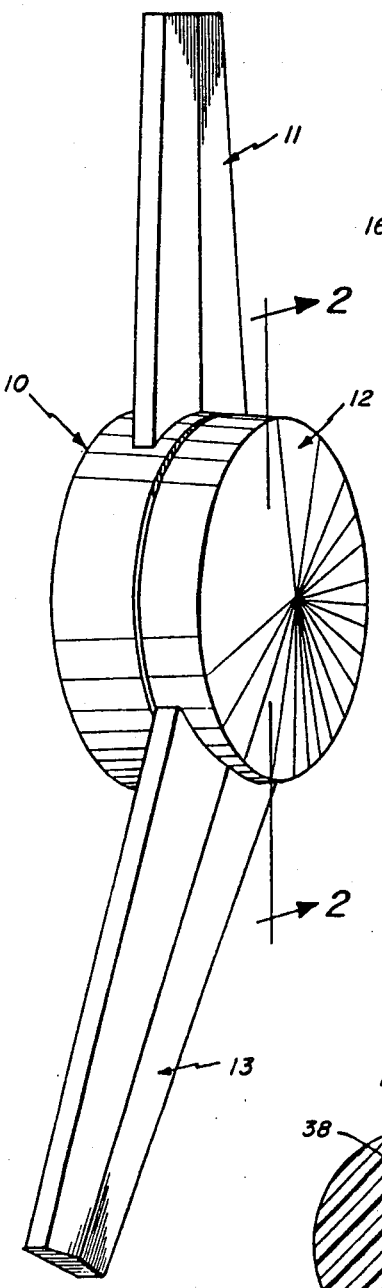
FIG. 1 is a perspective view of a clock constructed in accordance with the principles of the present invention.
Figure 2:
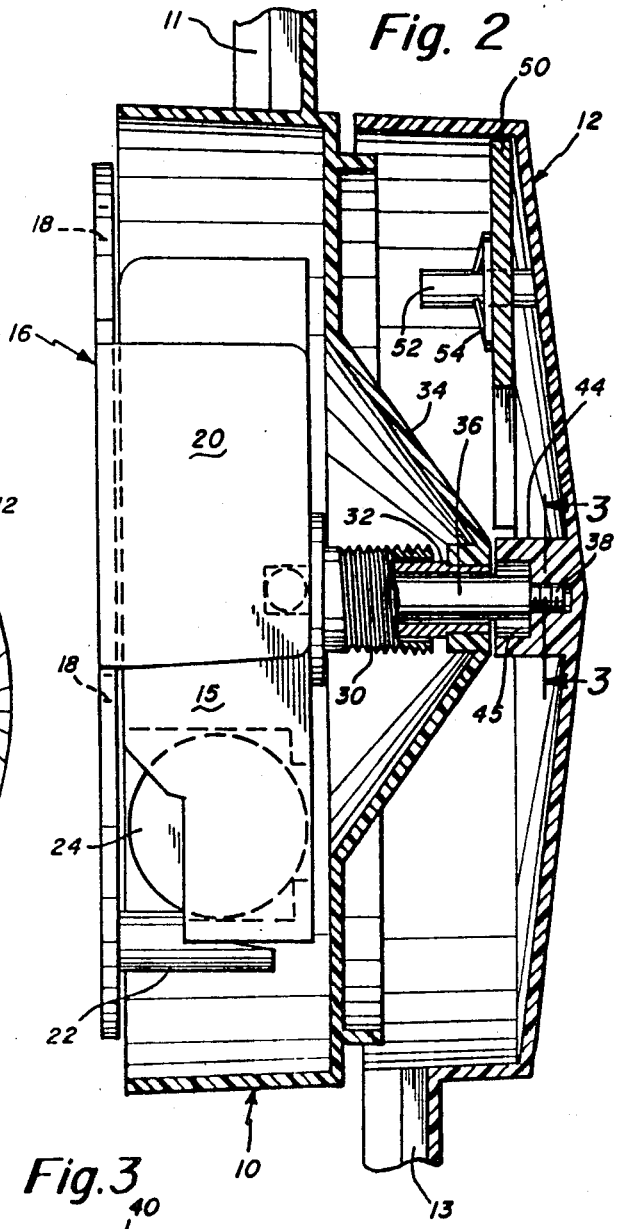
FIG. 2 is a cross-sectional view taken through the clock along line 2—2 of FIG. 1 showing internal details of the clock.
Figure 3:
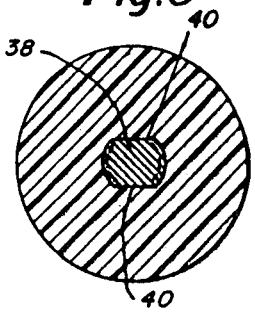
FIG. 3 is a cross-sectional view taken along line 3—3 of FIG. 2 showing further details of the coupling between the minute shaft and the housing associated with the minute hand.
Figure 4:
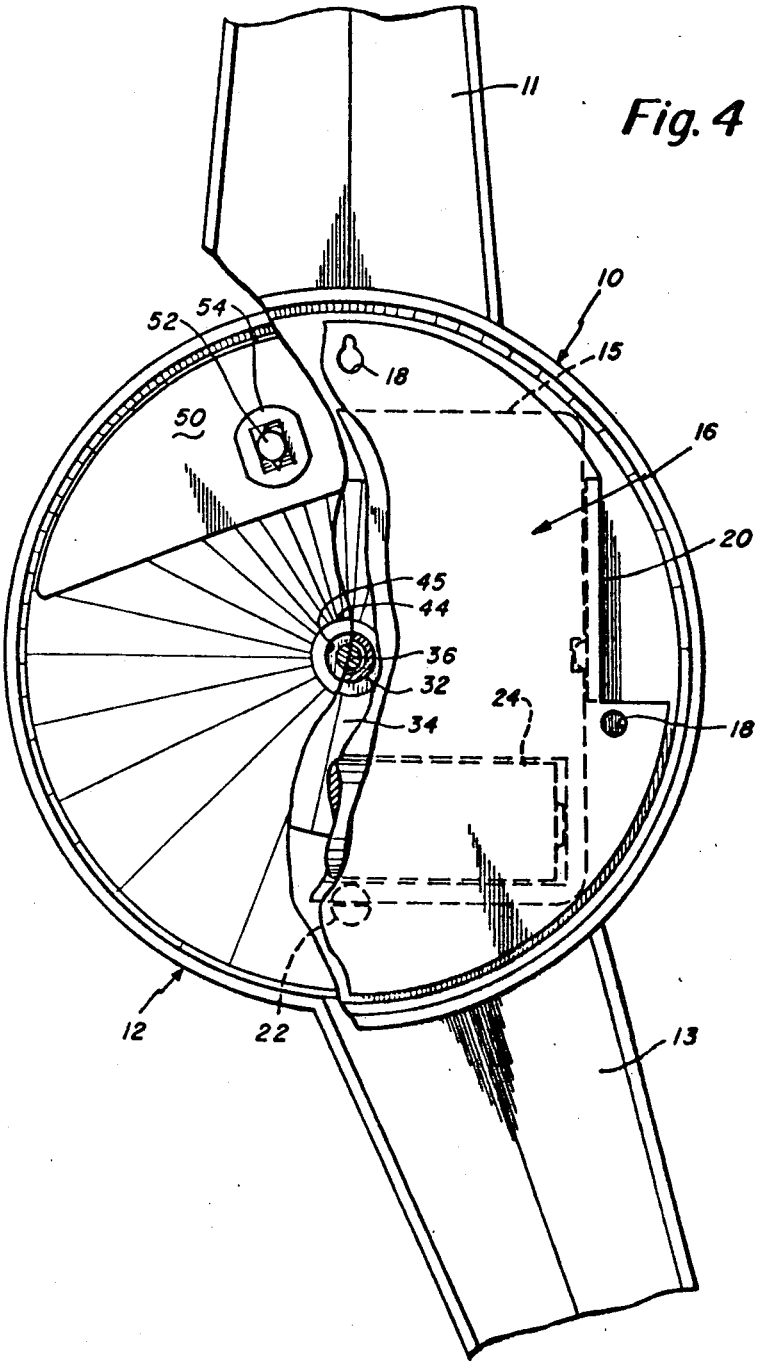
FIG. 4 is a rear view of the clock partially cut away to show still further details of the construction.

Reference is now made to the drawings including FIGS. 1–4. FIG. 1 is a perspective view of a clock constructed in accordance with the principles of the invention. FIGS. 2 and 3 are cross-sectional views showing further details of the internal construction of the clock. FIG. 4 is a rear view partially cut away also showing further details of the construction.

From FIG. 1 it is noted that the clock basically comprises two housing members identified in FIG. 1 as the hour housing 10 in the minute housing 12. Both of these housings are approximately the same, comparable diameter as noted. The hour housing 10 supports the hour hand 11. Similarly, the minute housing 12 integrally supports the minute hand 13. It is noted that the minute hand 13 has a longer length than the hour hand 11 so that it is clear as to which hand is designating minutes and which hand is designating hours.

FIG. 2 is a cross-sectional view taken along line 2—2 of FIG. 1 and shows further details of the housings. It is noted that the hour housing 10 has disposed therein the timing mechanism 15. The timing mechanism 15 is of conventional design and is supported by a support bracket 16. The support bracket 16 is preferably provided with the three-spaced holes 18 as noted in FIG. 4 which enables the support bracket to be secured to a wall where the clock is to be hung. The support bracket 16 has side pieces 20 that support the timing mechanism on the side and also has a bottom support post 22 as illustrated, for example, in FIG. 2. Also illustrated in FIGS. 2 and 4 is the placement of the battery 24. This is supported under the timing mechanism for providing power to the timing mechanism.

Thus, the timing mechanism 15 is adapted to be driven from the battery source and is supported in a fixed stationary position from the bracket 16. The bracket 16 is in turn secured to a wall or the like.

The timing mechanism is of conventional design and is provided with multiple output shafts which are each driven at a different speed depending upon whether they are driving hour, minute, or second hands. From the illustration of FIG. 2, there is shown an output support collar 30 having extending therethrough the hour driven shaft 32. The diameter of the very end of the shaft 32 is adapted to force-fit engage with the centrally disposed hole in the conical segment 34 of the hour housing 10.

Inside of the hour driven shaft 32 and concentric therewith is the minute shaft 36 which has an end 38 that is threaded as indicated in FIG. 2. This end also has oppositely disposed flats 40. Reference is now made to FIG. 3 which shows the flats 40 and also the threading on the remainder of the end 38.

Reference is also now made to FIG. 2 and the coupling of the minute driven shaft which includes the aforementioned threaded shaft end having opposed flats which is adapted to force-fit in a centrally disposed hole on the inside of the minute housing. In this regard in FIG. 2, note the support post 44 and a hole 45 therein. The hole 45 is stepped as illustrated in FIG. 2 with the smaller diameter segment thereof adapted to actually receive the threaded end 38 of the minute hand. The diameter of the smaller segment of the hole in the post 44 is comparable to the distance between the flats 40 and is smaller than the diameter between the threaded segments of the shaft end. This is provided so that there is a force-fit between the threaded shaft end 38 and the hole in the minute housing. The flats 40 prevent any rotation between the shaft end 38 and the minute housing.

FIGS. 2 and 4 also illustrate a counterweight 50 that is disposed within the minute housing 12. The counterweight 50 has a hole in it which is received by the support post 52 extending from the internal wall of the minute housing 12 toward the periphery thereof. FIG. 2 also shows the use of a clip fastener 54 for securing the counterweight 50 in place.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A clock comprising;

an hour housing supporting an hour hand integral therewith, a minute housing proportional in diameter to said hour housing and supporting a minute hand integral therewith, a battery-operated timing mechanism supported primarily in said hour housing and having hour driven shaft means coupled to said hour housing for driving the hour hand and minute driven shaft means coupled to said minute housing for driving the minute hand, a counterweight disposed inside the minute housing along a peripheral side opposite to the minute hand, the coupling of said minute driven shaft means including a threaded shaft end having opposed flats adapted to force-fit in a centrally-disposed hole on the inside of the minute housing, and means for supporting the timing mechanism in a fixed position.

2. A clock as set forth in claim 1 wherein said minute and hour housings are of substantially circular shape and said minute and hour hands are integrally supported to be in adjacent positions when in line.

3. A clock as set forth in claim 2 wherein said hour housing has a conical cavity adapted to receive the hour driven shaft including a central hole for receiving said hour driven shaft in force-fit engagement.

4. A clock as set forth in claim 3 wherein said minute housing has a centrally-disposed inner post having therein the hole for receiving the minute driven shaft.

5. A clock as set forth in claim 4 wherein the diameter of the hole in the minute housing is less than the diameter of the threaded shaft end so as to provide the force-fit.

6. A clock as set forth in claim 5 wherein the counterweight includes a metal disk.

7. A clock as set forth in claim 6 wherein said minute housing has a small post on the inside for supporting the disk at a hole in the disk.

8. A clock as set forth in claim 7 including a fastener for the disk.

9. A clock comprising; an hour housing supporting an hour hand integral therewith, a minute housing proportional in diameter to said hour housing and supporting a minute hand integral therewith, a timing mechanism supported primarily in said hour housing and having hour driven shaft means coupled to said hour housing for driving the hour hand and minute driven shaft means coupled to said minute housing for driving the minute hand, a counterweight disposed inside the minute housing along a peripheral side opposite to the minute hand, the coupling of said minute driven shaft means including a threaded shaft end having at least one flat thereon, said minute housing having a centrally-disposed hole on the inside thereof for force-fit receipt of the shaft end, said at least one flat preventing relative rotation between said minute driven shaft means and minute housing, and means for supporting the timing mechanism in a fixed position.

10. A clock as set forth in claim 9 wherein said minute and hour housings are of substantially circular shape and said minute and hour hands are integrally supported to be in adjacent positions when in line.

11. A clock as set forth in claim 10 wherein said hour housing has a conical cavity adapted to receive the hour driven shaft including a central hole for receiving said hour driven shaft in force-fit engagement.

12. A clock as set forth in claim 11 wherein said minute housing has a centrally disposed inner post having therein the hole for receiving the minute driven shaft.

13. A clock as set forth in claim 12 wherein the diameter of the hole and the minute housing is less than the diameter of the threaded shaft end so as to provide said force-fit.

14. A clock as set forth in claim 13 wherein the counterweight includes a metal disk.

15. A clock as set forth in claim 14 wherein said minute housing has a small post on the inside for supporting the disk at a hole in the disk.

16. A clock as set forth in claim 15 including a fastener for the disk.

17. A clock as set forth in claim 9 wherein said threaded shaft end has opposed flats.

* * * * *